United States Patent [19]

Skwarek

[11] 4,241,439

[45] Dec. 23, 1980

[54] SUBSTRATE BOARD/CARRIER FRAME ASSEMBLY

[75] Inventor: Jean P. Skwarek, Besancon, France

[73] Assignee: Timex Corporation, Waterbury, Conn.

[21] Appl. No.: 109,735

[22] Filed: Jan. 4, 1980

[51] Int. Cl.[3] ..... G04B 1/00; G04C 3/00; G04B 37/00

[52] U.S. Cl. ..... 368/204; 368/276; 361/400

[58] Field of Search ..... 368/88, 203, 204, 276; 361/397–401

[56] References Cited

U.S. PATENT DOCUMENTS

| | | | |
|---|---|---|---|
| 3,583,148 | 6/1971 | Wolber | 308/276 |
| 3,911,663 | 10/1975 | Kern et al. | 368/276 |
| 4,087,975 | 5/1978 | Miyasaka et al. | 368/204 |
| 4,114,365 | 9/1978 | Matsuura et al. | 368/204 |
| 4,196,577 | 4/1980 | Ohno et al. | 368/88 |

*Primary Examiner*—Vit W. Miska

*Attorney, Agent, or Firm*—Edward J. Timmer

[57] ABSTRACT

A substrate board carrying circuit components is fastened to the plastic carrier frame of an electronic timepiece at one location by an elongated battery spring contact which is affixed to the carrier frame such as by adhesive and which passes through aligned passages provided through both the frame and substrate board, eventually terminating beyond the substrate board in a contact post where a solder bead is applied functioning not only as a connection to the circuitry on the substrate board but also as a retaining head holding the substrate board to the carrier frame. Preferably, the substrate board and carrier frame are held together at a second location by a stab joint arrangement wherein a protrusion on either the board or frame is received in a corresponding recess in the other member.

13 Claims, 6 Drawing Figures

SUBSTRATE BOARD/CARRIER FRAME ASSEMBLY

FIELD OF THE INVENTION

This invention relates to an electronic timepiece and, more particularly, to improved means for assembling the substrate board carrying the timekeeping circuitry to the frame carrying other timepiece components such as the gear train, driving motor and the like.

DESCRIPTION OF THE PRIOR ART

Electronic timepieces of the "analog" type, i.e., having conventional rotating hands have been developed wherein a stepping motor is accurately driven from a time based electrical driving signal. The driving signal may come from a transistor pulse-producing circuit or, more recently, from an integrated circuit having a quartz oscillator time base.

In this type of timepiece, it is common to mount the electrical circuit components such as an oscillating circuit, driving circuit, divider circuit and quartz oscillator on a so-called substrate board which in turn is attached to a plastic frame carrying the gear train, driving motor, battery spring contact and sometimes also the battery itself. One type of substrate board adapted specifically for use in such electronic timepieces is shown in the Nagasawa U.S. Pat. No. 3,958,408 issued May 25, 1976.

In the past, the substrate board has typically been assembled to the carrier frame by mechanical means, usually screws or clips. Of course, this type of assembly technique possesses the drawback that an increased number of parts is required to assemble the timepiece and each fastener must be tightened, engaged or the like.

SUMMARY OF THE INVENTION

Accordingly, it is an object of the present invention to provide for an electronic watch a simplified substrate board/carrier frame assembly which requires no additional fasteners or other parts to hold it together.

It is another object of the invention to provide a method for assembling the substrate board and carrier frame which employs a soldering type step not only to connect the electrical circuit components together but also to effect fastening of the substrate board to the carrier frame.

In a typical embodiment of the present invention, an elongated battery spring contact affixed to the carrier frame, such as by an adhesive, extends through aligned passages through both the carrier frame and substrate board and terminates beyond the substrate board in a contact post. A bead of conductive material such as solder is applied around the contact post to connect it to adjacent electrical circuitry on the substrate board and at the same time provide a retaining head for holding the substrate board to the carrier frame at one location. The substrate board preferably includes a protrusion such as an projecting nose at another location adapted to be received in a corresponding recess in the carrier frame to effect a stab joint connection between the board and frame at the other location. Thus, in a preferred embodiment, the substrate board and carrier frame are held together at two locations, at one location by the stab joint connection and at the other by the battery spring contact which is affixed to the frame near one end and soldered to the substrate board circuitry near the other end.

DESCRIPTION OF PREFERRED EMBODIMENTS

Figure 1:
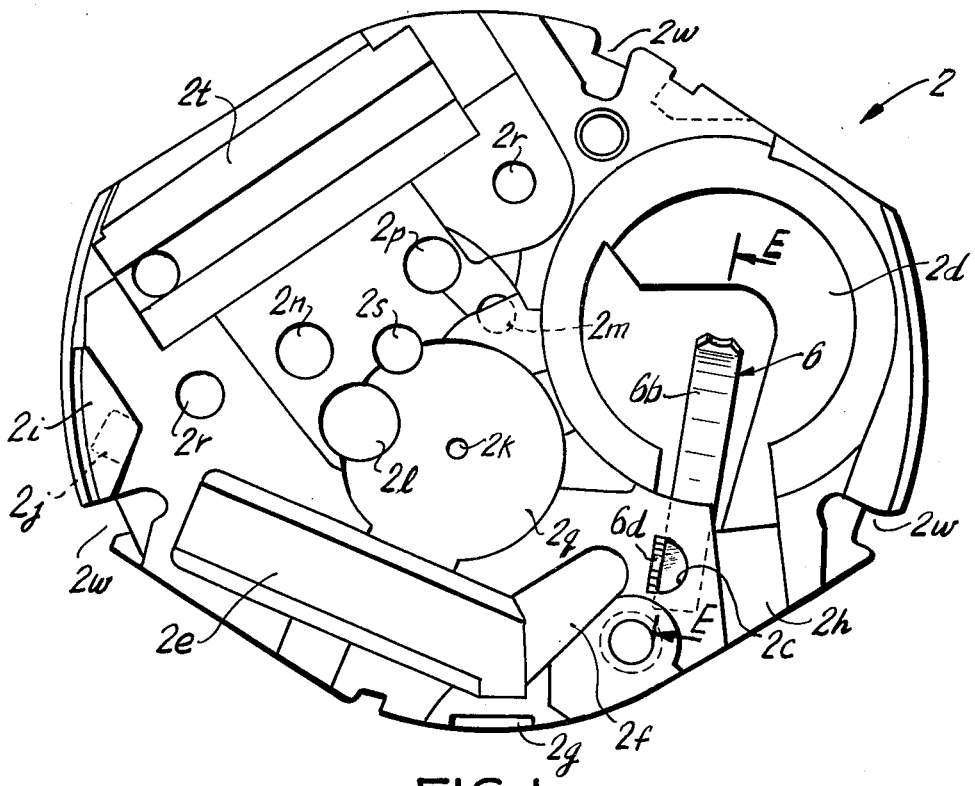
FIG. 1 is a bottom plan view of a carrier frame used in an electronic analog timepiece.
Figure 2:
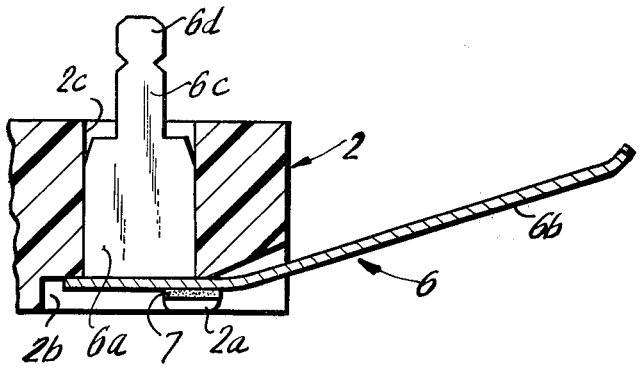
FIG. 2 is a cross-section view through the carrier frame along line E—E of FIG. 1.
Figure 3:
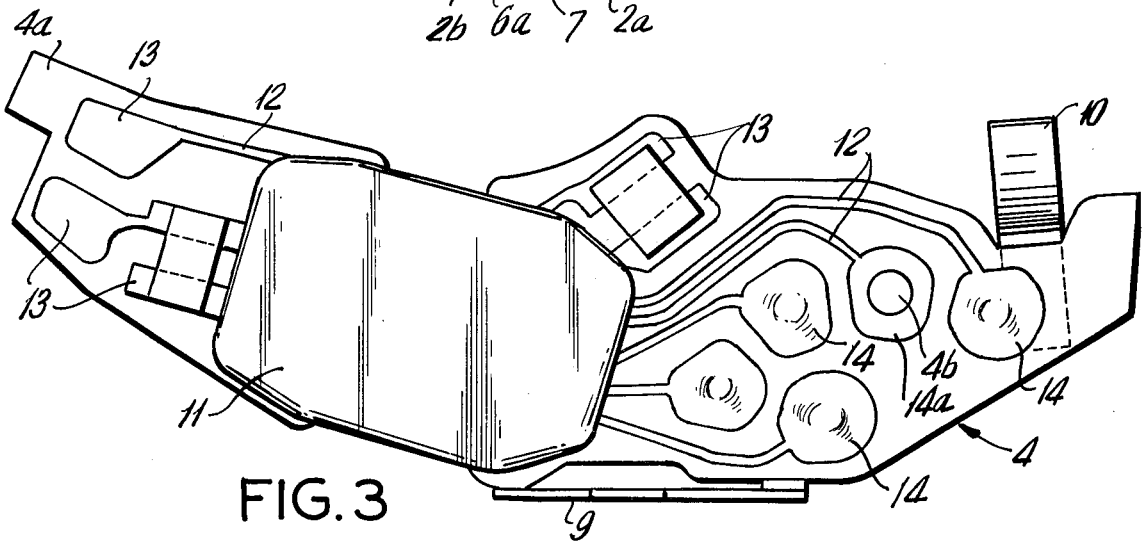
FIG. 3 is a bottom plan view of a substrate board used in the timepiece.
Figure 4:
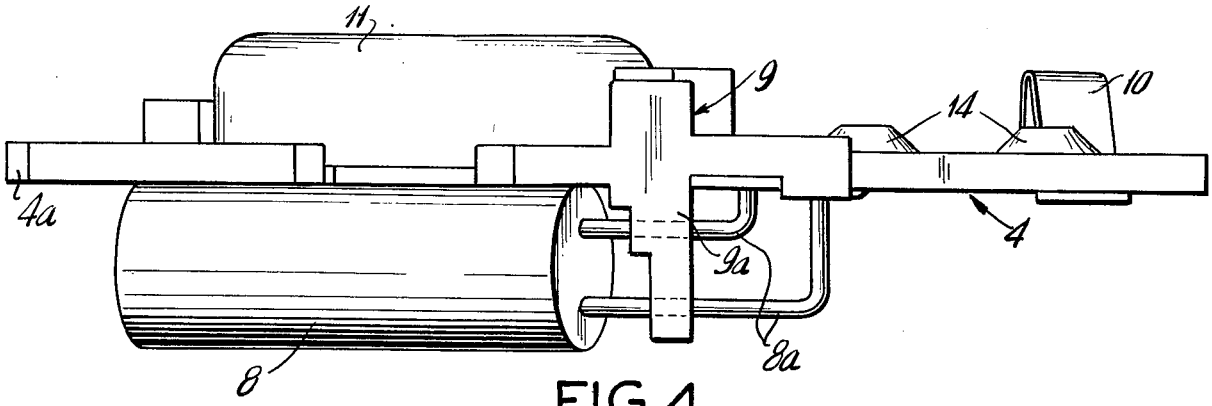
FIG. 4 is a side view of the substrate board of FIG. 3.

FIG. 1 illustrates a preferred carrier frame useful in an electronic analog timepiece for carrying the gear train, electric motor such as a stepping motor for driving the gear train as well as the substrate board of FIGS. 3 and 4. The carrier frame 2 is typically molded or otherwise formed of insulating material such as plastic to include compartments, slots, passages and the like to receive the various components to be carried. For example, L-shaped battery spring contact 6 is shown attached to the frame, specifically to a flange 2*a* extending into a channel 2*b* of the frame by adhesive 7 such as epoxy, shown most clearly in FIG. 2. The frame also includes a first molded vertical passage 2*c* of semi-circular cross-section through which the upright shoulder 6*a* of the spring contact 6 passes. The oblique contact arm 6*b* of the spring projects into a generally circular enclosure 2*d* molded to receive the battery or button cell providing power to the timepiece, FIG. 1.

Features molded into carrier frame 2 specifically to accommodate timekeeping components carried on the substrate board 4 include rectangular slot 2*e* extending through the thickness of the frame and interconnected angular trough 2*f* extending only partially through the frame, the slot 2*e* being adapted to receive the quartz oscillator 8 and the trough 2*f* the lead wires 8*a* from the quartz oscillator to connector pads mounted on the substrate board, FIG. 4. Open side slot 2*g* is molded into the frame to accommodate depending arm 9*a* of flexible switch plate 9 mounted on the side of the substrate board, while a shallow channel 2*h* is molded to extend from the battery enclosure 2*d* to the side of the frame to receive the other battery spring contact 10 which is soldered to a terminal of the substrate board. Finally, a vertical post 2*i* is molded adjacent the end of rectangular slot 2*e* and includes a hollow recess 2*j* therein adapted to receive the projecting nose 4*a* at the end of the substrate board 4 in a stab joint type connection.

Other molded features in the carrier frame 2, for example molded circular cavities or bores 2*k*, 2*l*, 2*m*, 2*n*, 2*p*, 2*q*, are provided to accommodate gear train components such as toothed wheels and shafts, while other molded features are adapted to receive components of the stepping motor, for example, circular bores 2*r* to receive the motor mounts, circular bore 2*s* the rotor bearing and rectangular trough 2*t* the coil of the motor. Of course, these molded features of the frame are varied as desired to suit different gear train lay-outs and motor constructions and their exact arrangement is not considered part of the present invention.

Other components mounted on the substrate board 4 include encapsulated integrated circuit chip 11, conductors 12, connector pads 13 and terminals 14 all well known to those skilled in the art.

Figure 6:
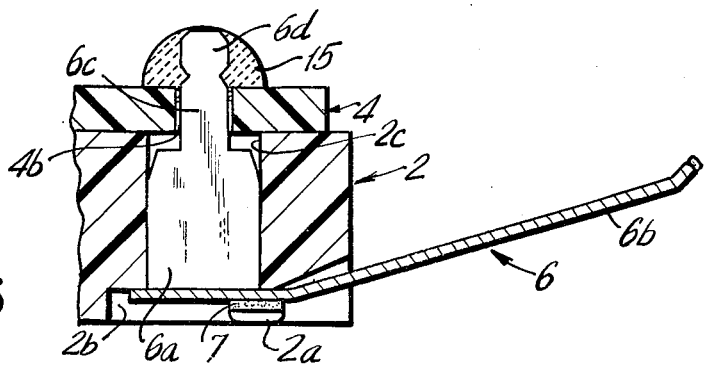
FIG. 6 is a cross-section view of the battery spring contact after soldering.

One important feature of the substrate board 4 is the aforementioned projecting nose 4*a* which is adapted to be inserted in the recess 2*j* of molded vertical post 2*i* of the carrier frame to effect connection between the board and frame at one location. Another important feature of the substrate board is the provision of a second vertical passage 4*b* adapted to be aligned with the first noncircular passage 2*c* in the carrier frame and to receive the upright support post 6*c* of the battery spring contact 6, for example as shown in FIG. 6. As shown most clearly in FIG. 3, the terminal 14*a* associated with the opening of the second passage 4*b* on the free side of the substrate board is in the form of annular conductor ring so as not to close off the opening.

Figure 5:
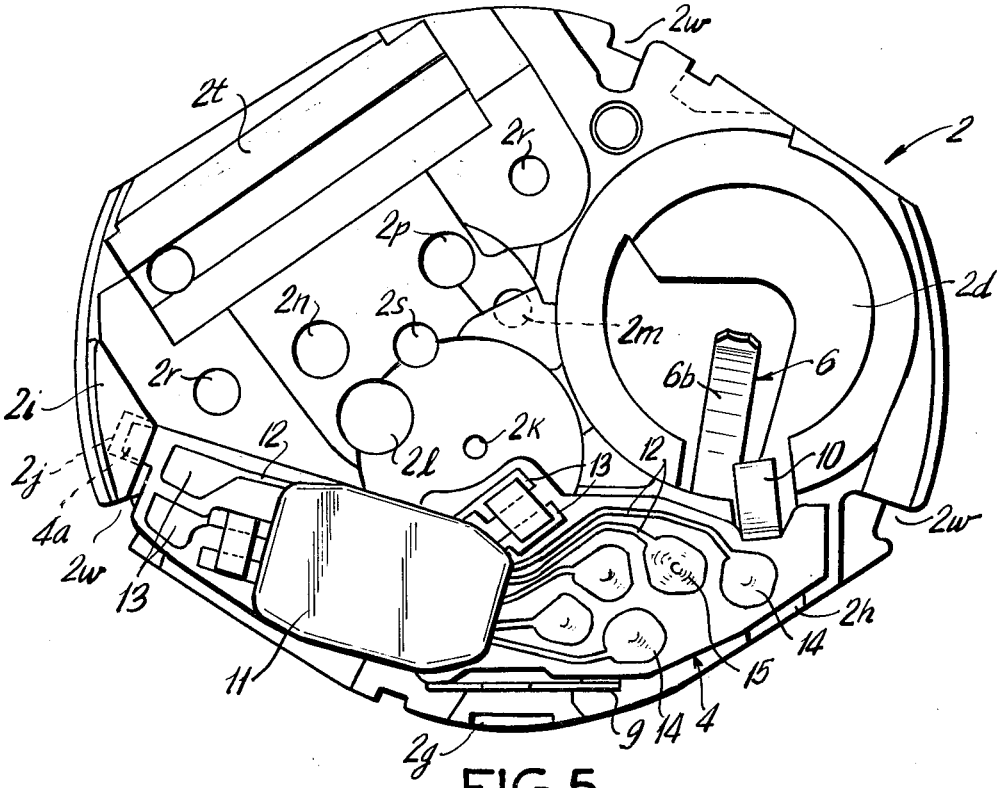
FIG. 5 is a bottom plan view of the substrate board assembled to the carrier frame.

Assembly of the substrate board 4 and carrier frame 2 is effected by first inserting nose 4*a* of the substrate board into recess 2*j* of post 2*i* of the frame and then aligning second vertical passage 4*b* of the substrate board with the supoort and contact posts 6*c* and 6*d* of the battery spring contact so that the posts extend through the passage with contact post 6*d* projecting beyond the free side of the substrate board, as shown in FIG. 6. Then, the contact post 6*d* is connected to annular terminal 14*a* on the substrate board by solder 15, FIG. 6, using conventional soldering techniques. The solder bead 15 not only connects the battery spring contact 6 to the terminal 14*a* and conductor associated therewith but also functions as a retaining head to hold the substrate board to the frame 2. To this end, the solder bead preferably has a dimension larger than the opening of second vertical passge 4*b*. FIG. 5 shows the substrate board and carrier frame fastened together at one location by the projecting nose 4*a* of the board received in recess 2*j* of frame post 2*i* and at a second location by the soldered connection 15 associated with battery spring contact 6.

The substrate board/carrier frame assembly of FIG. 5 is mounted in a timepiece case (not shown) by conventional support rings which may be screwed or snap-fitted into the case in well known fashion. Usually, the dial plate (not shown) for the timepiece is supported on the top side of the substrate board/frame assembly by resilient depending legs which are crimped into notches 2*w* around the periphery of the carrier frame.

While there has been described what is herein considered to be preferred embodiments of the invention, other modifications may occur to those skilled in the art, and it is desired to cover in the appended claims all such modifications as fall with the true spirit and scope of the invention.

I claim:

1. An assembly for an electronic timepiece powered by a battery comprising:

(a) a carrier frame having a first passage extending therethrough, (b) a substrate board having one side juxtaposed against the carrier frame and one free side, said board having a second passage extending therethrough from one side to the other aligned with said first passage through the carrier frame and also having a circuit component on the free side thereof, (c) an elongated battery spring contact affixed to the carrier frame and adapted to contact the battery at one end and extend through the aligned first and second passages through said frame and board, terminating beyond the free side of said board in a contact post, and (d) a bead of conductive material deposited around the contact post, connecting said post to said circuit component on the free side of the substrate board, whereby said conductive bead not only completes the electrical circuitry between the spring contact and circuit component but also functions as a retaining head to hold the substrate board against the carrier frame.

2. The assembly of claim 1 wherein the carrier frame is molded plastic and includes compartments and passages for receiving the gear train, driving motor and battery of the timepiece.

3. The assembly of claim 1 wherein the substrate board carries the timekeeping components of the timepiece, including a quartz oscillator, integrated circuit chip, conductors, terminals and connector pads.

4. The assembly of claim 3 wherein the circuit component on the free side of the board is an annular terminal disposed around the opening of the passage in that side.

5. The assembly of claim 1 wherein the bead of conductive material is a solder bead.

6. A carrier frame and substrate board assembly for an electronic timepiece powered by a battery, characterized in that said frame and board are held together at one location by:

(a) one of said frame and board including a protrusion and the other a corresponding recess adapted to receive the protrusion and hold said frame and board together at one location, and at another location by:

(b)

(1) said frame and board having aligned first and second passages therethrough with said board carrying a circuit component on the side thereof facing away from said frame, (2) an elongated battery spring contact affixed to the carrier frame and adapted to contact the battery at one end and extend through the aligned first and second passages through said frame and board, terminating in a contact post beyond the free side of said board carrying the circuit component, and (3) a bead of conductive material deposited around the contact post, connecting said post to said circuit component on the substrate board, whereby said frame and board are held together at a second location.

7. The assembly of claim 6 wherein the carrier frame includes the recess and the substrate board includes the protrusion in the form of a projecting nose.

8. The assembly of claim 6 wherein the carrier frame is molded plastic and includes compartments and passages for receiving the gear train, driving motor and battery of the timepiece.

9. The assembly of claim 6 wherein the circuit component on the substrate board is an annular terminal disposed around the passage opening in that side.

10. The assembly of claim 9 wherein the substrate board also carries the timekeeping components of the timepiece, including a quartz oscillator, integrated circuit chips, conductors, terminals and connector pads.

11. The assembly of claim 6 wherein tthe bead of conductive material is a solder bead.

12. A method for assembling a carrier frame and substrate board with a circuit component on one side thereof for use in a battery-powered electronic timepiece comprising:

(a) placing the frame and board together with the side of said board carrying the circuit component facing away from said frame and with first and second passages through said frame and board alignment, (b) attaching an elongated battery spring contact to said frame and extending said spring contact through the aligned first and second passages through said frame and board so that it terminates in a contact post beyond the side of said board carrying the circuit component, and (c) depositing a bead of solder around the contact post to connect said post to the circuit component on said board and also to provide a retaining head for holding said frame and board together at that location.

13. The method of claim 12 including the additional step of attaching the frame and board together at a second location by inserting a projecting nose on the substrate board into a corresponding recess in the carrier frame.

* * * * *